United States Patent [19]

Heimberger

[11] 4,142,276

[45] Mar. 6, 1979

[54] WARP-KNIT SLIDE-FASTENER STRINGER HALF AND METHOD OF MAKING SAME

[75] Inventor: Helmut Heimberger, Locarno, Switzerland

[73] Assignee: Optilon W. Erich Heilmann GmbH, Cham, Switzerland

[21] Appl. No.: 728,033

[22] Filed: Sep. 30, 1976

[30] Foreign Application Priority Data

Apr. 7, 1976 [DE] Fed. Rep. of Germany ..... 2615001

[51] Int. Cl.[2] ..... A44B 19/00

[52] U.S. Cl. ..... 24/205.16 C; 66/195; 66/190

[58] Field of Search ..... 66/190–195; 24/205.16 C, 205.1 R, 205.13 C, 205.1 C

[56] References Cited

U.S. PATENT DOCUMENTS

| | | | |
|---|---|---|---|
| 2,485,307 | 10/1949 | Newman | 66/193 |
| 2,706,898 | 4/1955 | Gross et al. | 66/193 |
| 3,183,685 | 5/1965 | Riehl | 66/193 |
| 3,448,595 | 6/1969 | Baltzer et al. | 66/195 |
| 3,708,836 | 1/1973 | Frolich et al. | 24/205.1 C |
| 3,848,556 | 11/1974 | Terada et al. | 24/205.1 C |
| 3,874,036 | 4/1975 | Yoshikawa | 24/205.1 C |
| 3,881,473 | 5/1975 | Corvi et al. | 66/195 |
| 3,922,760 | 12/1975 | Matsuda | 24/205.1 C |
| 3,983,721 | 10/1976 | Matsuda | 66/195 |

*Primary Examiner*—Ronald Feldbaum
*Attorney, Agent, or Firm*—Karl F. Ross

[57] ABSTRACT

A slide-fastener stringer half has an elongated warp-knitted tape having a pair of opposite faces and a pair of opposite longitudinally extending edges. The tape is knit with a plurality of chained warp yarns each forming a respective longitudinally extending loop chain or pillar defining a respective longitudinally extending wale, a first weft filament laid into and extending over two of the chains at one of the edges of the tape, a group of second weft yarns lapped into the chains across the full width of the tape, and a group of third weft yarns laid into all of the chains except that chain immediately at the one edge. A continuous mono-filamentary coupling element having a succession of turns is secured to one face of the tape along the one edge by stitching which overlies the turns, extends through the tape, and has a needle thread on the other face of the tape between two of the chains at the one edge.

9 Claims, 3 Drawing Figures

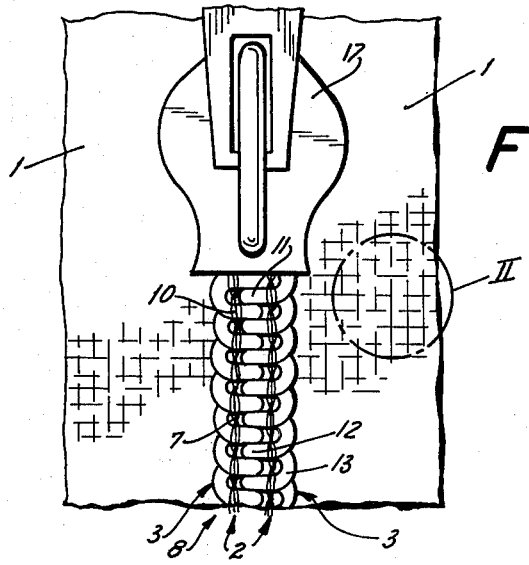
FIG. 1
FIG. 2
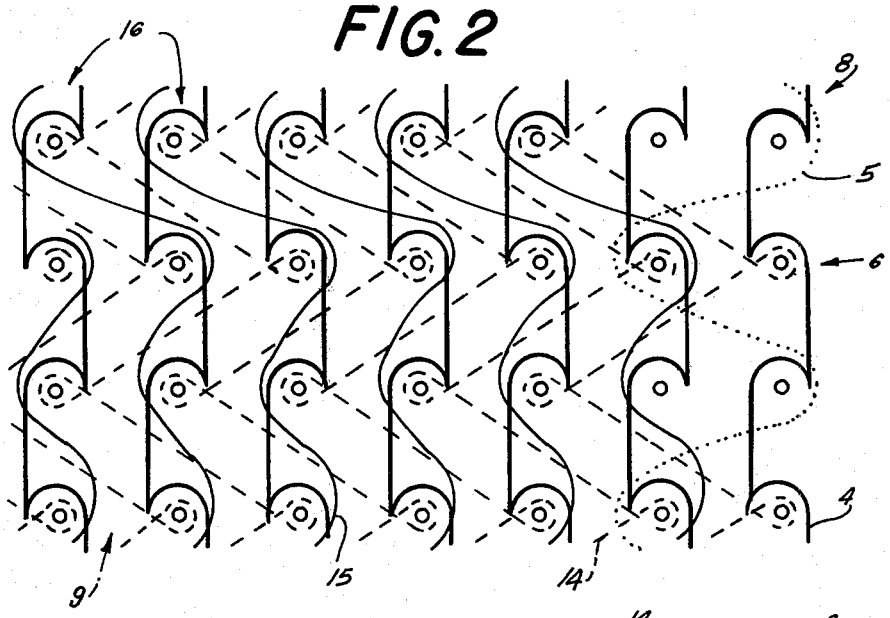
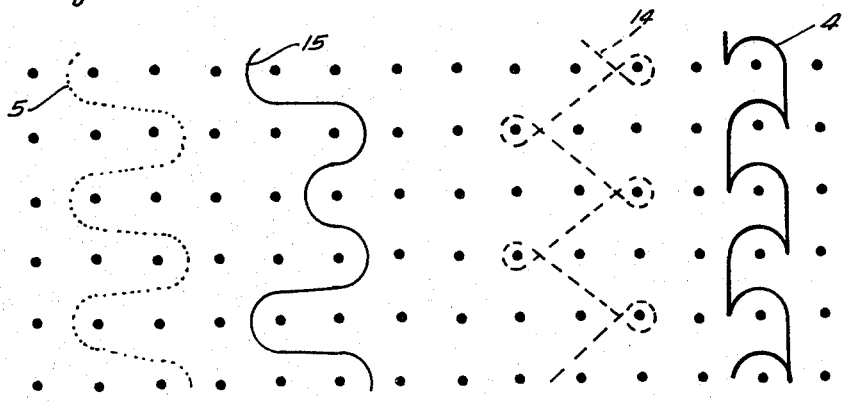
FIG. 3

WARP-KNIT SLIDE-FASTENER STRINGER HALF AND METHOD OF MAKING SAME

CROSS-REFERENCE TO RELATED APPLICATIONS

This application is related to my concurrently filed copending and commonly assigned patent applications Ser. Nos. 728,136; 728,032; 728,134; 728,135; 728,034; 728,133; 728,035; 728,031; and 728,132.

FIELD OF THE INVENTION

The present invention relates to a slide-fastener stringer half. More particularly this invention concerns such a stringer half having a warp-knit tape to one of whose edges is secured a helicoidal monofilamentary coupling element by means of stitching.

BACKGROUND OF THE INVENTION

It is known to warp-knit support tapes for a slide-fastener stringer. A coupling element is then stitched to an edge of each of the tapes. Two such tapes along with their stitched-on coupling elements constitute a slide-fastener stringer that can later be equipped with a slider and end stop members so as to form a complete slide fastener.

Normally each of the tapes is knitted as a so-called stabilized fabric (see U.S. Pat. No. 3,708,836 corresponding to German Published application DT-OS 2,016,141). This knit is normally made of a plurality of chains or pillars formed by so-called warp yarns into which is laid a plurality of weft yarns. A warp yarn here is meant to refer to any filament running mainly in the warp direction and a weft yarn similarly refers to any filament running transverse thereto. Such a fabric offers relatively good dimensional stability, and the valley between the edgemost wale and the adjoining wale has proven convenient for stitching-on of the coupling element.

More particularly, in this arrangement the wales are of the single-bar type formed as warp chains which are bridged only by the filler or weft. As indicated the sole connecting threads or yarns between the warp chains are the laid-in weft filaments or yarns which extend over four warp chains each so that four such weft inlays fill each warp loop to provide the transverse stability of the tape (stability in the plane of the tape perpendicular to the warp chains) and, in addition, prevent longitudinal extension and contraction (change of dimension in the plane of the tape parallel to the warp chains). The dimensional stability is most pronounced if the tapes are composed of synthetic-resin yarn which has been thermofixed, i.e. subjected to a heating or ultrasonic treatment which relaxes internal stress within the yarn.

The advantage of single-bar warp chains, i.e. individual spaced apart wales of loops interconnected only by the weft, is that channels are formed between wales so that the row of stitching for attaching the coupling element can lay along one of these channels or valleys.

The relatively simple knit of the prior art does not make use of the considerable capacity of a modern knitting machine.

Furthermore, such a stabilized fabric is also very likely to ravel, since whenever one of the pillars of the warp yarns is broken ravelling will occur, and any breaking of any of the weft yarns will similarly cause ravelling. Even the slightest amount of damage to a slide-fastener stringer tape using a helicoidal monofilamentary coupling element can result in deformation, that is stretching or squeezing-together, of the turns of the coupling element so as to make the slide fastener produced thereby useless. Finally, the speed with which the coupling element can be stitched to the support tape is limited.

OBJECTS OF THE INVENTION

It is therefore an object of the present invention to provide an improved slide-fastener stringer half and a method of making same.

Another object is the provision of such a method which utilizes the full capabilities of a modern warp-knitting machine.

Another object is to provide such a stringer half which can be quickly assembled, which has excellent dimensional stability, and which is not easily damaged by unravelling or snagging.

Still another object is to provide a stringer tape which enables the coupling element to be attached more rapidly by double-chain (lock) stitching.

SUMMARY OF THE INVENTION

These objects are attained according to the present invention in a slide-fastener half having an elongated warp-knitted tape having a pair of opposite faces and a pair of opposite longitudinally extending edges. This tape is knit with a plurality of chained warp yarns each forming a respective longitudinally extending loop chain or pillar defining a respective longitudinally extending wale, a first weft filament laid into and extending over two of the chains at one of the edges, a group of second weft yarns lapped into said chains across the full width of the tape, and a group of third weft yarns laid into all of the chains except at least that chain immediately at the edge. A continuous monofilamentary coupling element having a succession of turns and lying on one face of the tape along the one edge is secured to this one edge by stitching while overlies the turns, extends through the tape, and has a needle thread on the other face of the tape between two of the chains at the one edge.

The warp chains are of the single-bar or single-needle type described in the aforementioned U.S. Patent, i.e. each wale is a single warp chain so that valleys are defined between the wales. The warp chains are not interconnected, the sole connection between them being the laid-in weft.

According to another feature of this invention the weft yarns which are not laid into the chains at the edge are laid in irregularly. By this is meant that the weft yarns extend across a predetermined number of chains in some of the courses and a different number of chains in the other of the courses. These irregularly laid in weft yarns are laid according to this invention in all but the edgemost wale of the tape, this wale being secured to the rest of the tape merely by the other weft yarns.

In other words, the invention provides an improvement in warp-knit slide-fastener stringer tape in which the single-needle warp chains are filled by a laid in weft which comprises:

a first weft yarn laid in over the two adjoining warp chains at the coupling edge of the tape;

a group of second weft yarns laid in across three warp chains all across the tape including the coupling-edge warp chain and forming a fabric or tricot pattern, these weft yarns being looped at each of the warp chains at which they reverse directions; and a group of third weft yarns extending all across the tape except the coupling-edge warp chain and lying in one or more warp chains, these weft yarns forming so-called "stationary" or stabilizing weft threads.

Preferably the weft yarns of the third group are provided in a varying pattern across the courses of the knit. By a "varying pattern" I mean a pattern whereby the third weft yarns shog across one or two wales alternately.

The double-lock stitch attaching the coupling element to the tape lies between the coupling-edge wale free from the stationary weft threads and the next warp chain.

Thus it is possible to produce a slide-fastener stringer tape which uses the full capacity of a standard warp-knitting machine. At the same time the longitudinal and transverse stability is excellent and the tendency of the fabric to ravel when snagged is reduced to a minimum. Furthermore the valley between the edgemost wale and the remaining wales is particularly apt for receiving the thread of the stitching that secures the coupling element to this tape.

BRIEF DESCRIPTION OF THE DRAWING

The above and other objects, features and advantages of the present invention will become more readily apparent from the following description, reference being made to the accompanying drawing in which:

FIG. 1 is a top view of a portion of a slide-fastener stringer half according to the present invention;

FIG. 2 is a diagrammatic view of the detail of FIG. 1 indicated by arrow II of FIG. 1; and FIG. 3 is a point-paper diagram illustrating the patterns of the yarns making up the tapes of the slide-fastener stringer half according to this invention.

SPECIFIC DESCRIPTION

As shown in FIG. 1 a slide-fastener stringer half has a pair of warp-knit tapes to each of whose edge 8 is secured a monofilamentary coupling element 3 by means of stitching 2. Each of these elements 3 comprises a succession of turns each in turn having a pair of shanks 12 lying in a common plane perpendicular to the direction of the elongation of the coupling element 3 and joined together at their front ends by a coupling head 11 which is grippable between the shanks 12 of the opposite turns. The upper shank 12 of each turn is jointed to the lower shank 12 of an adjoining turn by means of a connecting bight 13.

The two shanks of each coupling member of "turn" have projections on the slide-fastener plane, i.e. the plane in which the tapes lie when the stringer is flat, which coincide or are congruent.

The two coupling elements may be interleaved by means of a slider 17 and end-stop members may be provided at their ends. Furthermore the stitching 10 is of stitch type 402 (Federal Standard 751*a*) and has a needle thread 7 which extends through the tape 1 and a looper thread 10 which overlies the shanks 3.

As best shown in FIGS. 2 and 3 each of the tapes 1 is formed of pillar-forming warp yarns 4, laid-in weft yarns 5 and 15, and lapped weft yarns 14. These yarns 4, 5, 14, and 15 together form a succession of transversely extending parallel courses 6 and a plurality of parallel longitudinally extending wales 16 separated by valleys 9. Each of the wales 16 is formed by a respective pillar constituted by a respective open-loop chained warp yarn 4.

The yarns 4, 5, 14, and 15 are patterned as follows:

warp yarn 4 — 1-0/0-1, weft yarn 5 — 0-0/2-2, fabric or tricot pattern lapped weft yarn 14 — 2-3/1-0, and weft yarn 15 — 1-1/0-0/0-0.

Thus the yarn 15 is irregularly laid in but all of the other yarns are regularly knitted.

As also shown in FIGS. 2 and 3 the yarn 5, only one of which is provided in each tape 1 at the edge 8 thereof, only extends across the two wales 16 at the edge 8. On the other hand the weft yarns 15 never extend into the edgemost wale of the tape 1, but the lapped weft yarns 14 do extend to this edgemost wale. This forms a valley which is perfectly suited for receiving the needle threads 7 of the stitching 2 securing the elements 3 to the tapes 1.

At least some of these yarns are shrinkable and after knitting of the tape the entire tape is subjected to a heat-treatment operation so as to shrink and thermoset it. It is also possible chemically to shrink the shrinkable yarn and the entire tape 1 may be formed of such a shrinkable yarn. Furthermore the yarns 4, 5, 14, and 15 are all of approximately the same gauge so as to make a very dense stabilized tape 1.

I claim:

1. A slide-fastener stringer half comprising:

an elongated warp-knitted tape having a pair of opposite faces and a pair of opposing longitudinally extending edges, said tape being knit with:

a plurality of chained warp yarns each forming a respective longitudinally extending warp-pillar loop chain defining a respective longitudinally extending wale, a first inlaid weft yarn laid into and extending only said first inlaid weft yarn passing between the two chains from course to course, over two of said chains at one of said edges, a group of second yarns in tricot-type pattern lapped into all of said chains across the full width of said tape, said second yarns bridging three warp chains from course to course and a group of third inlaid weft yarns laid into all of said chains except that chain immediately at said one edge, a continuous monofilamentary coupling element having a succession of turns and lying on one face of said tape along said one edge; and stitching overlying said turns, extending through said tape, and having a needle thread on the other face of said tape between said two of said warp chains at said one edge.

2. The stringer half defined in claim 1 wherein said third weft yarns extend alternately across one and two warp chains from course to course.

3. The stringer half defined in claim 1 wherein at least one of said yarns is shrunk.

4. The stringer half defined in claim 1 wherein said yarns are all approximately the same gauge.

5. A method of making a slide-fastener stringer half comprising the steps of:

chaining a plurality of warp yarns into an array of parallel and longitudinally extending wale-forming chains;

laying a group of first weft yarns into said chains over two of said chains at an edge of said array;

laying a group of second weft yarns into all of said chains except the chain closest said edge;

lapping a third group of weft yarns in tricot-type pattern into said array of chains across the full transverse width thereof, whereby said yarns form a tape having a pair of opposite longitudinally extending edges and a pair of opposite faces;

thereafter juxtaposing a monofilamentary coupling element having a succession of turns with one of said faces at one of said edges; and thereafter stitching said element to said tape with stitching overlying said turns, passing through said tape, and lying on the other face of said tape between two of the wales formed at said edge, said warp yarn being patterned 1-0/0-1, said first weft yarns being patterned 0-0/2-2, said second weft yarns being patterned 1-1/0-0/2-2/0-0, and said third weft yarns being patterned 2-3/1-0.

6. The method defined in claim 5, further comprising the step of shrinking said one yarn after the steps of chaining, laying-in and lapping.

7. The method defined in claim 5 wherein said stitching is a multithread double-lock stitch.

8. The method defined in claim 7 wherein said yarns all have substantially the same gauge.

9. In a slide-fastener stringer comprising a pair of stringer halves each having a knitted support tape formed with a multiplicity of single-needle warp chains and a weft laid into the warp chains, the two warp chains at a coupling edge of each tape defining a valley receiving a row of double-chain stitching attaching a coupling element to the tape for interdigitation with the coupling element of the other tape upon movement of a slider therealong, the improvement wherein said weft comprises for each tape:

a first weft yarn laid in only over the two adjoining warp chains along the coupling edge of the tape;

a group of second weft yarns each laid in across three warp chains all across the tape including the warp chain at said edge; and a group of third weft yarns extending all across the tape except the warp chain at said edge and each lying in at least one warp chain, said warp chains each having a 1-0/0-1 pattern;

said first weft yarn having a 0-0/2-2 pattern;

said second weft yarns each having a 2-3/1-0 pattern; and said third weft yarns each having a 1-1/0-0/2-2/0-0 pattern.

* * * * *